United States Patent [19]

Starnes

[11] Patent Number: 4,688,295

[45] Date of Patent: Aug. 25, 1987

[54] VACUUM CLEANER ATTACHMENT

[76] Inventor: Doris H. Starnes, 1476 Danbury Dr., Norcross, Ga. 30093

[21] Appl. No.: 720,511

[22] Filed: Apr. 5, 1985

[51] Int. Cl.[4] ..... A47L 9/06

[52] U.S. Cl. ..... 15/395; 15/398; 15/415 R

[58] Field of Search ..... 15/398, 399, 400, 415 R, 15/396, 416, 395

[56] References Cited

U.S. PATENT DOCUMENTS

| | | | |
|---|---|---|---|
| 2,206,738 | 7/1940 | Brock et al. | 15/395 |
| 2,243,120 | 5/1941 | Pollitt | 15/396 X |
| 2,496,813 | 2/1950 | Peterson | 15/398 X |
| 2,606,338 | 8/1952 | DeLorenzo | 15/396 X |
| 4,034,435 | 7/1977 | Grabathy | 15/416 X |
| 4,332,051 | 6/1982 | LaMonte | 15/398 X |
| 4,402,105 | 9/1983 | Garbacik | 15/398 |
| 4,459,720 | 7/1984 | Ahlf et al. | 15/416 X |

FOREIGN PATENT DOCUMENTS

| | | | |
|---|---|---|---|
| 516121 | 12/1952 | Belgium | 15/400 |
| 51102 | 3/1955 | Canada | 15/395 |
| 104536 | 5/1942 | Sweden | 15/395 |

*Primary Examiner*—Chris K. Moore

*Attorney, Agent, or Firm*—Newton, Hopkins & Ormsby

[57] ABSTRACT

A longitudinally slotted straight tube extension for the wand of a canister-type vacuum cleaner has plugged into its slot or slots narrow elongated brush elements which enable effective cleaning of very narrow spaces between furniture pieces and between furniture and closely adjacent walls.

7 Claims, 5 Drawing Figures

VACUUM CLEANER ATTACHMENT

BACKGROUND OF THE INVENTION

Conventional vacuum cleaner attachments, such as upholstery cleaning nozzles, are not well suited for cleaning out large narrow spaces between walls and furniture items, such as desks and file cabinets or similar narrow spaces between furniture pieces in homes and offices. Accordingly, it is the object of this invention to provide a simple and inexpensive vacuum cleaner attachment for this purpose which is compatible with almost any vacuum cleaner and its other customary attachments.

Other objects and advantages of the invention will become apparent to those skilled in the art during the course of the following description.

DETAILED DESCRIPTION

Figure 1:
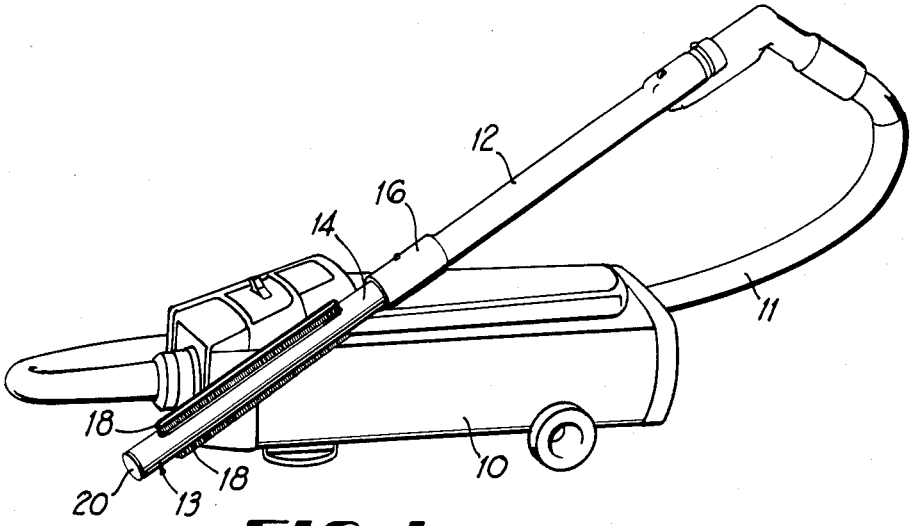
FIG. 1 is a perspective view of a vaccum cleaner equipped with the cleaning attachment according to the present invention.
Figure 2:
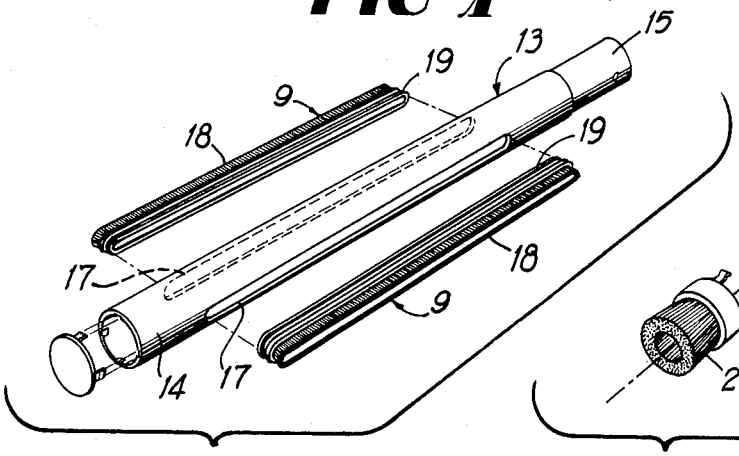
FIG. 2 is an exploded perspective view of the attachment.

Referring to the drawings in detail wherein like numerals designate like parts, a canister-type vacuum cleaner 10 includes the customary hose 11 and straight hollow cylindrical tubular hose wand or tube 12 adapted at its forward end to be releasably received and be coupled to various cleaning attachments. In FIG. 1, a cleaning attachment 13, according to the present invention, is installed in the proper use position on the wand 12.

The attachment 13 comprises a hollow cylindrical elongated straight tube section or extension 14 having a open end and a reduced diameter portion 15 at one end for engagement within a coupling sleeve 16 of the wand 12, in a well-known manner. The tube section 14 is provided on diametrically opposite sides thereof with straight elongated longitudinal or axially extending suction slots 17, preferably extending along the major portion of the length of the tube section 14.

A pair of identical elongated straight hollow cleaning brush elements or members 9 of narrow construction cooperate respectively with slots 17. The members 9 include attached elastomeric hollow rectangular heads 19 respectively provided with perimetrical grooves 22 adapted to be removably received by section 14, plugged into the slots 17, each head 19 being removable with a snap action. Brushes 18 are carried by their proximal end in their heads 19. The heads 19 can be separated from the tube section 14, whenever desired. When head 19 is received in its associated slot 17, the hollow interior of head 19 forms an air intake opening or slot, the mouth of which is surrounded by the outwardly protruding bristles 18. Each head 19 is of substantially the same length as the slot 18 and extends axially for a major portion of the length of tube section 14. When the brush members 9 are in their respective slots 17, the bristles 18 extend generally radially outwardly from the sides of the tube section 14. When the attachment 13 is installed on wand 12, and the vacuum cleaner 10 is attached, air is drawn from tube section 14, thereby drawing air through the opening in each head 19. Thus, air is drawn past the brushes 18 into the opening of heads 19.

Figure 3:
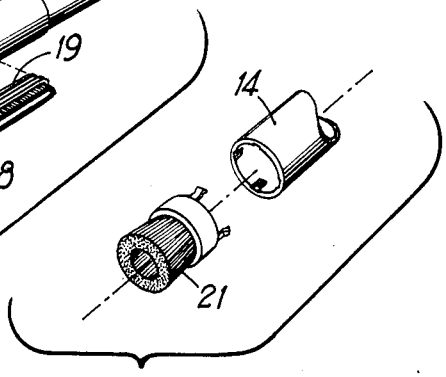
FIG. 3 is a similar view showing a variant of the invention in FIG. 2.

Referring to FIG. 3, in lieu of the cap 20, a forward end circular cleaning brush 21 can be plugged into the leading end of tube section 14.

Figure 4:
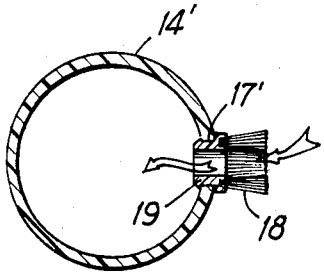
FIG. 4 is a transverse vertical section through an attachment according to an alternative embodiment of the invention.

In an alternative embodiment of the invention, FIG. 4, a tube section 14' may contain a single longitudinal slot 17' on one side thereof only. In this case, a single hollow cleaning brush 18 having the attached plug-in head 19, as previously described, is employed, rather than two opposite side brushes.

Figure 5:
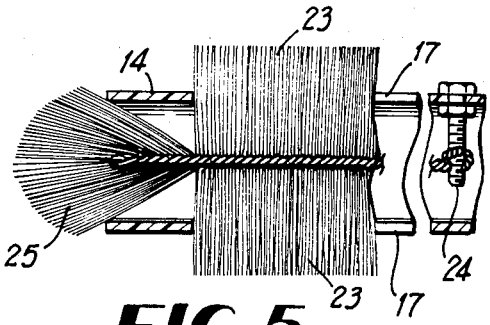
FIG. 5 is a fragmentary longitudinal vertical section through an attachment according to another embodiment of the invention.

In FIG. 5, another embodiment of the invention is shown in which the cleaning brush has a center longitudinal twisted wire stem 22 including opposite side bristles 23 which extend through the slots 17 of tube section 14 of the attachment. The stem 22 is anchored to a retaining screw 24 on the tube section 14. Additional bristles 25 on the leading end of stem 22 project from the forward end of the tube section 14.

In the use of the invention in any of its embodiments, the tube section 14 mounting the brush or brushes 18 or bristles 23 is thrust into narrow spaces between walls and furniture pieces, or between furniture pieces, and is very effective in quickly removing cobwebs or other debris from such narrow spaces.

The attachment is simple, convenient to use and ecomomical to manufacture. It adds notably to the cleaning capabilities of any vacuum cleaner, and satisfies a particular cleaning need not heretofore satisfied in the art.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A vacuum cleaning attachment comprising, an elongated tube section adapted for coupling to a vacuum cleaner hose wand and being provided with at least one longitudinally elongated slot in the side of said tube section, and a cleaning brush element having an elastomeric, hollow head, said elastomeric head having a perimetrical groove adapted to be plugged removably into said slot and retained therein, said element having bristles projecting outwardly from said side of said tube section, said head providing means for allowing air flow past said bristles into said tube section, whereby the attachment can draw air past said bristles and into said tube section when air is drawn through said wand and said tube section.

2. A vacuum cleaning attachment as defined in claim 1, and said means for allowing air flow including registering suction passages formed through said head along substantially the entire length of the cleaning brush element and slot.

3. A vacuum cleaning attachment as defined in claim 2, and said tube section having a pair of said slots along diametrically opposite sides thereof, and a pair of the cleaning brush elements one for each slot adapted to be plugged into the slot.

4. A vacuum cleaning attachment as defined in claim 1 and including a closure element for the forward end of the tube section.

5. A vacuum cleaning attachment as defined in claim 1 and including a closure element for the forward end of said tube section, said closure element including bristles projecting outwardly therefrom.

6. A vacuum cleaning attachment comprising, an elongated tube section adapted for coupling to a vacuum cleaner hose wand and being provided with at least one longitudinally elongated slot in the side of said tube section, an anchoring means secured to said tube section and having an anchoring element projecting radially therein, and a cleaning brush element secured to said anchoring means for cooperation with said slot, said element having a central longitudinal stem connected at one end of said anchoring element, with bristles projecting outwardly from said side of said tube section and through said slot, and a tuft of bristles attached to the forward end of said stem and projecting through the forward end of said tube section to hold said stem substantially in the center of said tube section, whereby the attachment can draw air past said bristles and into said tube section when air is drawn through said wand and said tube section.

7. A vacuum cleaning attachment as defined in claim 6, and said tube section having a pair of said slots on opposite sides thereof and said bristles attached to said stem projecting through and outside of both of said slots along the full lengths thereof.

* * * * *